US006493881B1

(12) United States Patent
Picotte

(10) Patent No.: US 6,493,881 B1
(45) Date of Patent: Dec. 17, 2002

(54) HEAD PROTECTOR FOR INFANTS AND SMALL CHILDREN

(76) Inventor: Brooke Picotte, 27 Wood Acres Rd., Brookville, NY (US) 11545

( * ) Notice: Subject to any disclaimer, the term of this patent is extended or adjusted under 35 U.S.C. 154(b) by 0 days.

(21) Appl. No.: 09/924,425

(22) Filed: Aug. 7, 2001

(51) Int. Cl.[7] ..... A42B 3/00
(52) U.S. Cl. ..... 2/413
(58) Field of Search ..... 2/410–414, 421, 2/423, 202, 208, 171, DIG. 3

(56) References Cited

U.S. PATENT DOCUMENTS

| | | | | |
|---|---|---|---|---|
| 2,969,547 A | | 1/1961 | Dye | |
| 3,039,109 A | | 6/1962 | Simpson | |
| 3,713,640 A | | 1/1973 | Margan | |
| 3,916,446 A | * | 11/1975 | Gooding | 2/3 R |
| 4,354,284 A | | 10/1982 | Gooding | |
| 4,581,773 A | | 4/1986 | Cunnane | |
| 4,646,367 A | | 3/1987 | El Hassen | |
| 4,663,785 A | | 5/1987 | Comparetto | |
| 4,745,637 A | | 5/1988 | Steele | |
| 5,075,903 A | | 12/1991 | Richoux | |
| 5,351,343 A | * | 10/1994 | Harbison | 2/423 |
| 5,768,715 A | | 6/1998 | Gregg, II | |
| 5,882,205 A | | 3/1999 | Peterson | |

OTHER PUBLICATIONS

Materials regarding "Bumper Beanie Head Protective Cap" dated prior Aug. 15, 2000; Materials regarding "Thumper Bumpers" dated prior to Sep. 9, 2000; Materials regarding "Head Bumpa" dated prior to Jul. 21, 2000; and Materials regarding "Gel Wear" dated prior to Feb. 6, 2001.

* cited by examiner

*Primary Examiner*—John J. Calvert
*Assistant Examiner*—Tejash Patel
(74) *Attorney, Agent, or Firm*—Coudert Brothers LLP

(57) ABSTRACT

The present invention is directed to a child's or infant's hat which protects at least the sides, top or rear of the wearer's head from injuries due to falls or bumps against hard objects. Generally, the head protector of the present invention comprises: (1) a cap member: (2) one or more flexible, resilient shock absorbent fluid-containing pads; and (3) an outer covering of pliable fabric material. The cap member is constructed so as to fully enclose and/or encapsulate the fluid-containing gel pads. The pads substantially surround the entire inner surface of the cap member, or a substantial portion thereof. The head protector of the present invention is fashionable, having an appearance and surface texture of a conventional hat worn by infants and small children.

26 Claims, 5 Drawing Sheets

HEAD PROTECTOR FOR INFANTS AND SMALL CHILDREN

BACKGROUND OF THE INVENTION

Infants and small children are especially susceptible to banging their heads on hard surfaces due to falls or slips. The typical infant or small child will sustain multiple falls on hard surfaces before it can learn to sit, crawl or walk. For example, infants often crawl beneath chairs and tables. While underneath these items, the child will bang her head when attempting to stand up or lift her head. While the resulting injuries are not life threatening, they cause swelling and bruising about the head. Moreover, the bang or bump to the head is quite traumatic, causing the child to cry or become agitated.

Small children capable of walking or running are particularly vulnerable to falls against table corners, walls and other hard, pointed surfaces. In some instances, serious head injuries can result when a child bangs his or her head against any of these items.

Much of the protective headgear currently available for infants and children is neither fashionable, comfortable nor effective. Many are usually bulky and restrictive. Also, most of a the current protective headgear for small children and infants is not enjoyable to wear, nor is it designed for use in the house during daily activities such as playing, crawling, and learning to walk. Much of the protective headgear for children is designed for outdoor athletic activities, such as soccer, baseball and other contact sports, and is not suitable for everyday wear.

The present invention overcomes the problems of currently available protective headgear by providing a head protector that is attractive, comfortable and effectively provides the infant or child head protection for extended periods of time in a fun, enjoyable manner. The present invention is also low cost and may be worn daily by the infant or child.

SUMMARY OF THE INVENTION

Accordingly, it is an object of the present invention to provide a head protector protective headgear for infants and small children.

It is a further object of the present invention to provide a head protector which is lightweight and comfortable to wear and will not interfere with the wearer's activities.

It is a further object of the present invention to provide a head protector that is enjoyable to wear by an infant or small child during their daily activities.

It is a further object of the present invention to provide a head protector that is configured to provide protection to at least the sides, top or rear of the wearer's head.

Other objects and advantages of the invention will become apparent upon reading the following detailed description and upon reference to the following drawings.

BRIEF DESCRIPTION OF THE DRAWINGS

For a further understanding of the nature and objects of the present invention, reference should be made to the following detailed description, taken in conjunction with the accompanying drawings, wherein.

DETAILED DESCRIPTION OF THE INVENTION

Figure 1:
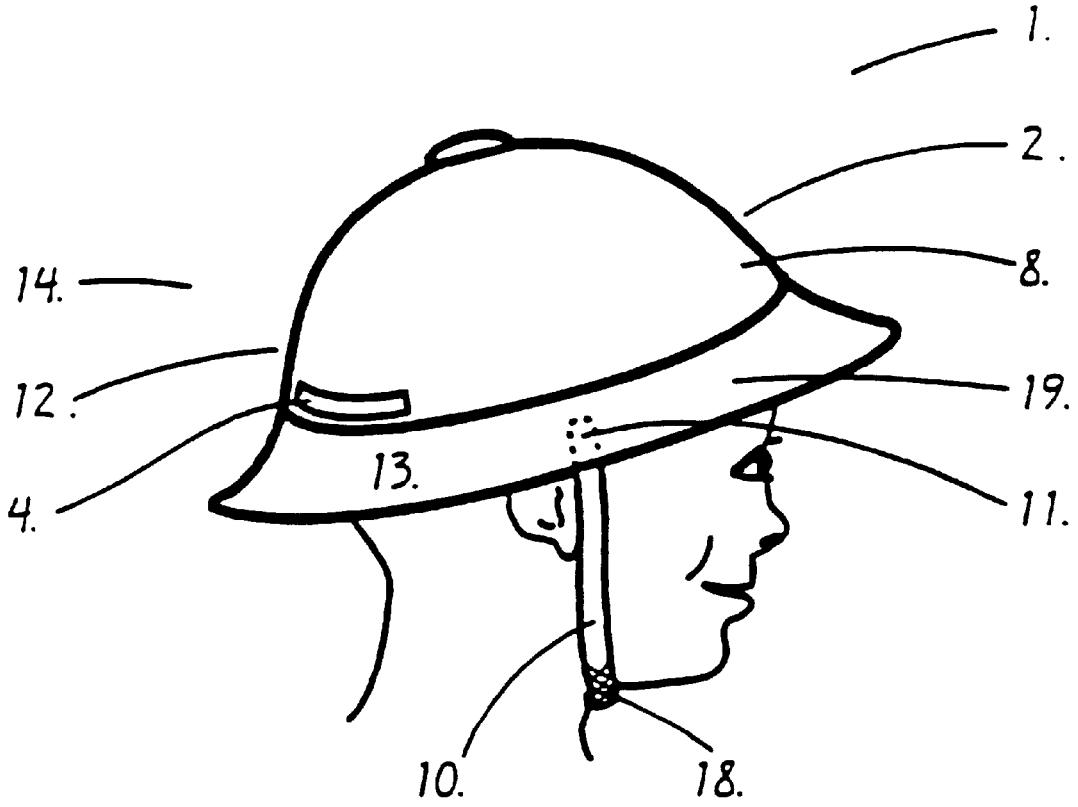
FIG. 1 is a side perspective view of an alternative embodiment of the head protector of the present invention.
Figure 2:
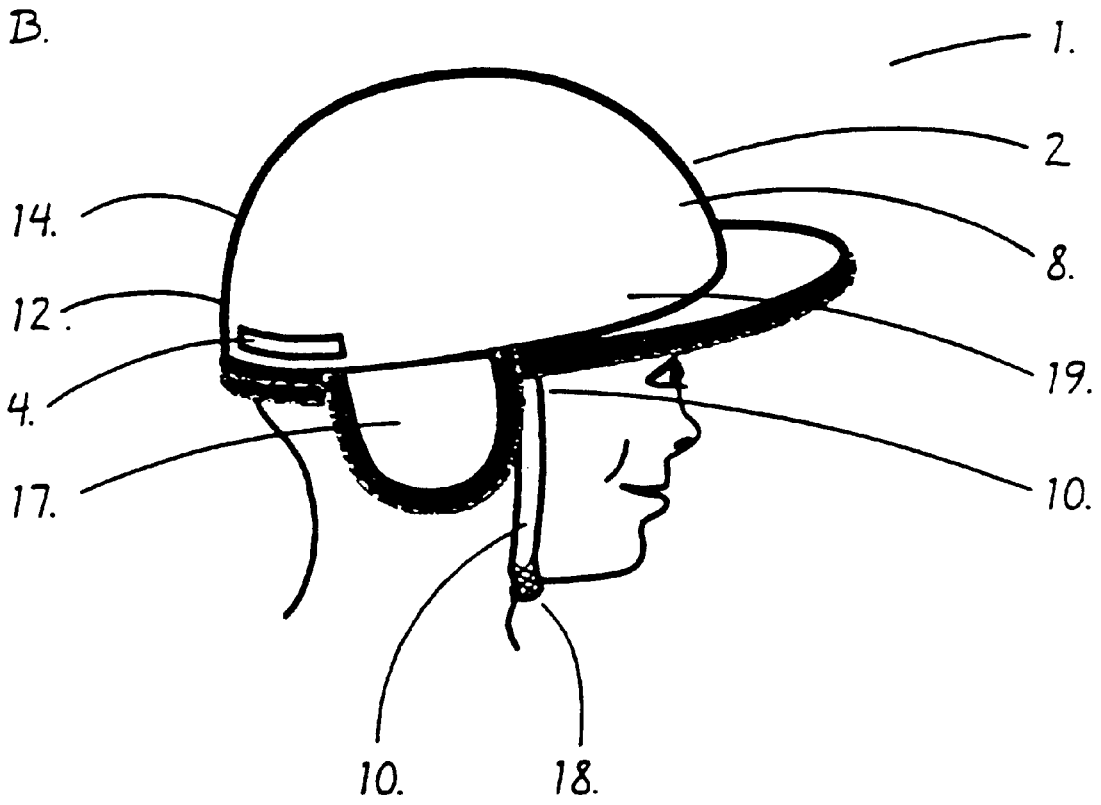
FIG. 2 is a side perspective view of another alternative embodiment of the head protector of the present invention.

With reference to the accompanying figures, head protector (1) comprises a cap member (2). The cap member (2) is shaped so that it encircles at least the entire upper portion of a wearer's head, or a substantial portion thereof, when worn. The cap member (2), when worn, overlies and protects at least the sides, the top or the rear portion of the wearer's head.

The cap member (2) also comprises one or more fluid-containing pads (7). The fluid-containing pads (7) are flexible, resilient and shock absorbent. The thickness of said pads may range from 0.20 inches to 6.0 inches. However, it should be understood that the thickness of the pads may vary in accordance with the desired yeildability or stretchability of the pad.

Each fluid-containing pad (7) contains a fluid (3) in the nature of a liquid, thus enabling the pad to flex and become fitted to the contours of the wearer's head. In a preferred embodiment, the fluid-containing pad (7) is at least substantially filled to capacity with the fluid. In some instances, the fluid-containing pads may be less than substantially filled to capacity. This allows a certain degree of compressibility of the entire volume of the pad upon impact. But even in the cases where the pads are entirely filled with liquid, there would be a certain amount of yieldability of the pads because of the elasticity of its outer skin, (15).

The outer skin (15) of the fluid-containing pad (7) is made of a resilient material of suitable durability such that it holds the fluid inside the pad and will not rupture upon light to moderate impact due to the wearer banging or bumping his head on a hard object. Specifically, the outer skin (15) may comprise a resilient material including but not limited to mylar, vinyl plastic polyurethane, a blend of vinyl-polyurethane or the like. The outer skin (15) may also be waterproof so that it will not spoil upon multiple washings of the present invention either by hand or in a washing machine.

The fluid (3) inside the fluid-containing pads (7) may be any fluid, such as water or any other non-toxic material. Such fluid (3) may also include any gelatinous fluid or any other viscous liquid that is of sufficient density or viscosity to provide protective benefits to the wearer's head upon impact due to falls or bumps against hard objects. Such fluids may include, but are not limited to, any silastic gelatin material or any other material containing polymeric silicones. The fluid (3) inside the fluid-containing pads (7) may also comprise a mixture of water and glycerin in about equal proportions or in a range between 30% and 70% glycerin and the remainder water, or other liquids such as syrups or similar viscous materials, grease or gels.

In the present invention, the fluid-containing pads (7) may comprise any shape, including but not limited to, squares, triangles, or rectangles. The fluid-containing pads (7) may also be spherical, cylindrical, conic, or disc-like, among other shapes.

Figure 3:
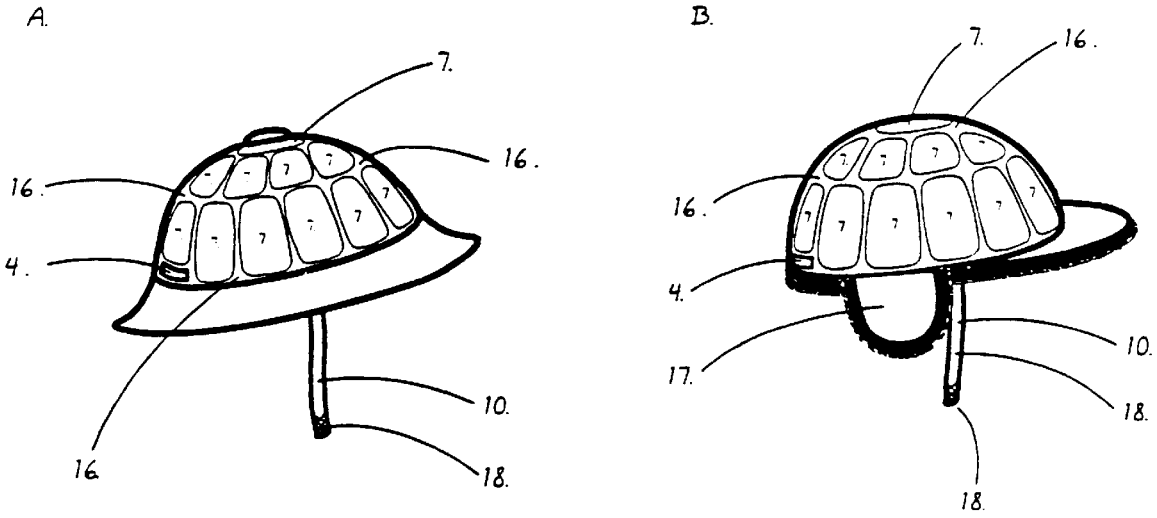
FIG. 3*a* and FIG. 3*b* represent a side perspective view of the embodiments of FIG. 1 and FIG. 2, respectively, illustrating a possible assembly of the fluid-containing pads utilized in the construction of the present invention, and an alternative head strap.
Figure 4:
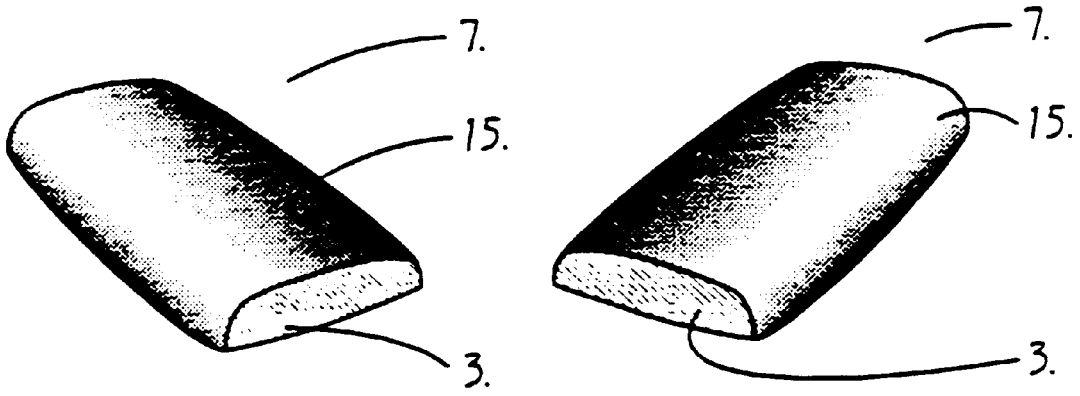
FIG. 4 is a cross sectional view of a non-limiting embodiment of fluid-containing pad utilized in the construction of the present invention.
Figure 5:
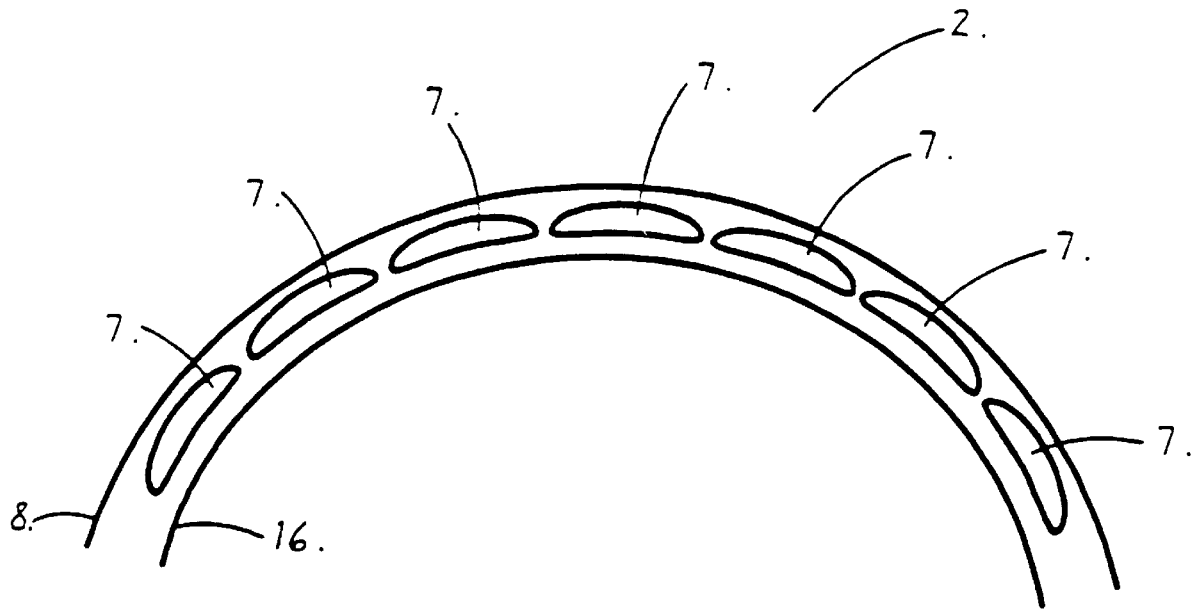
FIG. 5 is a cross-sectional view of a cap member utilized in the construction of the present invention.

In one alternative embodiment of the present invention, multiple fluid-containing gel pads (7) are positioned in a regular and spaced assembly, wherein the pads are generally equidistant from each other. (E.g., FIGS. 3A and 3B). The assembly of the pads (7) may also comprise multiple pads interconnected and positioned in irregular intervals. In another embodiment of the present invention, multiple pads may be positioned to form meshes of varying sizes and shapes therebetween. If desired, one single fluid-containing pad may be utilized in the construction of the present invention provided that it adequately protects at least the sides, top or rear of the wearer's head.

In another alternative embodiment, some fluid-containing gel pads (7) may be interconnected, as opposed to being positioned separately from other pads utilized in the construction of the present invention. For example, the head protector of the present invention may comprise multiple pads interconnected to each other or it may comprise a combination of non-interconnected pads and interconnected pads. In another alternative embodiment, the fluid-containing pads are substantially uniformly distributed along the inner surface (16) of the cap member (2).

In another alternative embodiment of the present invention, the fluid-containing pads (7) are positioned such that they cover one or more portions of the entire inner surface (16) of the cap member (2) or at least a substantial portion thereof. It should be understood, however, that the present invention is not limited to any specific number or sizes of fluid-containing gel pads or assemblies thereof. Rather, any number, size or assembly may be utilized in the construction of the present invention, so long as the pads adequately protect at least the sides, top or rear of the wearer's head from injuries due to falls or bumps against hard objects.

The cap member (2) further comprises an outer surface (8) of pliable fabric material. Examples of suitable material for the outer surface (8) of cap member (2) include, but are not limited to cotton, linens, knits, woven and non-woven fabrics, or any combination thereof. Other suitable fabrics may include an absorbent, towel-like fabric that is substantially stretch resistant, such as terry. Such terrys may include but are not limited to single and double faced terry, Turkish terry, French terry, boucle, velour or baby terry, or any combination thereof. The pliable fabric of the outer surface may also comprise an insulating fabric, including, but not limited to wool, microfiber, fleece, ultra suede, felted fabrics, padded fabrics, thinsulate, or any combination thereof. Other suitable fabrics may also include water repellant fabrics, such as, for example, Gortex™, nylon, plastic, rubber, Teflon™, or any combination thereof. Fabrics treated with a water repellent coating may also be suitable. Additional suitable fabrics may include silk, rayon, mesh, leather, velvet, cashmere, camel hair or any combination thereof.

The cap member (2) may be structured so that it fully encloses and/or encapsulates the fluid-containing pads (7), thereby concealing the pads from view. This gives the head protector (1) an appearance of a fashionable hat worn by infants and children. For example, the fluid-containing pads (7) may be enclosed or encased between the outer surface (8) and inner surface (16) of cap member (2). This can be achieved, for example, by engaging the outer surface (8) and inner surface (16) to form a space therebetween in which the pads can be positioned. In this instance, for example, the edges of the outer surface (8) and inner surface (16) may be sewn together to from a pocket in which the pads can be placed. Alternatively, the fluid-containing pads (7) may not be encased between the outer surface (8) and inner surface (16) of cap member (2). Instead, the pads may be positioned underneath the outer surface (8) of the cap member (2) so that the pads contact the wearer's head directly, or the fluid-containing pads may be covered by another material positioned beneath outer surface (8) and/or on top of inner surface (16).

In another alternative embodiment, the present invention may comprise an assembly of fluid-containing pads (7) whereby the assembly itself gives a fashionable and pleasant appearance when worn thus eliminating the need to incorporate cap member (2) in the construction of the present invention. An example of such an embodiment would include an assembly of fluid-containing gel pads resembling a lace pattern.

In another alternative embodiment of the present invention, the cap member (2) has a strap (10) for securing the head protector (1) on the wearer's head. The strap (10) comprises a first end (11) and a second end (12), shot shown. The first end (11) is affixed to the first side (13) of the cap member (2). The second end (12), not shown, is affixed to the other side (14), not shown, of cap member (2). The strap (10) may comprise an elastic or non-elastic material, including but not limited to leather, canvas, cotton or lycra.

Alternatively, strap (10) may be affixed to the lower area of hat (1). The strap (10) may be affixed to head protector (1) by using VELCRO™ type material, buttons, or any suitable means for removable affixing the chin strap (10) thereof. Chin strap (10) may also permit adjustment of the size of the band to accommodate different sized head.

In another alternative embodiment of the present invention, a protective ear flap (17) is removable and/or adjustably connected to each side of cap member (2). Each protective ear flap may comprise one or more fluid-containing pads (7) covered by a pliable material, such as those described herein. Ear flap (17) will be large enough to sufficiently cover and/or protect the wearer's ears from elements of the weather or injury. Flap sizes with respect to width or diameter may vary depending upon whether or not they contain fluid-containing pads, although their shape are preferably spherical or circular.

Protective ear flap (17) may be attached to the cap member at the sides or top of hat (2) by any known means in the art, including but not limited to using attached strings or straps to tie in a bow or cooperating snap means or VELCRO™ positioned at or near the sides or top of the hat.

In another alternative embodiment of the present invention, a sizing strap (4) (e.g., a velcro sizing strap) is positioned on the outer surface (8) of the cap member (2). The sizing strap encircles the cap member (2) along its base. The sizing strap may be positioned along either the inner surface (16) or outer surface (8) of the cap member (2). The sizing strap may be extended or reduced in size by utilizing a double strap sizing mechanism which could comprise but is not limited to Velcro. The sizing strap may extend from two narrow aperatures in the outer surface at the rear of hat (1). The sizing strap can be manipulated by the wearer to best fit his/her head size by folding one strap on top of the other or sliding one strap along the other and securing it with a fastening means, including but not limited to velcro, or snaps. The sizing strap may be made of a material that differs from the fabric of hat (1) and may or may not be covered on the exterior side of the strap with the same fabric covering the outer surface (8) of the cap member (2).

The chin strap (10) may also have a closing member (18), including but not limited to snaps or a velcro closing member. The closing member may comprise two strips of material attached to the end portions of the chin strap at the rear of hat (1). The sizing straps may connect the two strips at a desired setting of the wearer by sticking together and maintaining the length of each strap set by the wearer.

Although intended primarily as a safety device for children, the present invention may also be useful to protect the head of the infirm or an aged individual who is in danger of falling while walking or standing. For example, the protective hat of the present invention may protect the heads of individuals with medical conditions or physical disabilities rendering them prone to falls as a result of compromised balance or strength. Individuals suffering form strokes or those who have recurring seizures, multiple sclerosis, Parkinson's diseases or certain neuropathological conditions would benefit from the protective hat of the present invention because it would reduce their risk of injury. Moreover, elderly people or those who are weakened or experience orientation problems due to the symptoms or treatments of other illnesses would also find use for the protective hat of the present invention. With respect to individuals with illnesses or disabilities, the present invention would be a desirable change form the currently available protective devices or helmets which are more bulky, restrictive and unfashionable.

While the present invention has been described in connection with the embodiments described herein, it will be understood that the present invention is capable of further modifications, and this application, including the appended claims, are intended to cover any variations, uses, or adaptations of the present invention following, in general, the principles of the present disclosures set forth herein and including such departures from the present disclosures that come with known or customary practices in the art to which the invention pertains.

We claim:

1. A protective hat suitable for everyday wear by infants, small children and physically disabled adults, comprising:

(a) a cap member having an inner surface and an outer surface; the outer surface of the cap member comprising a pliable material, the cap member being sized so that, when worn, the cap member encircles the upper portion of a wearer's head;

(b) tie cap member, when worn, overlies and protects at least the sides, the top and the rear of the wearer's head;

(c) the cap member comprises a plurality of individual fluid-containing pads, said pads being flexible, resilient and shock absorbent; wherein the plurality of fluid-containing pads being positioned one from the other to form a spaced assembly along the inner surface of the cap member;

(d) each of the outer surface and inner surface of the cap member having outer edges, said outer surface and inner surface being connected to each other along their respective edges such that the fluid-containing pads are entirely enclosed therebetween;

(e) the head protector being made of a pliable material and is fashionable; and (f) the head protector, when worn, is adapted for everyday wear and is adapted to be worn by an infant, small child and physically disabled adult, the physically disabled adult having a medical condition, the symptoms of which compromise the adult's balance or strength rendering the adult prone to falls when walking or standing;

(g) the head protector being so constructed such that tie head protector, when worn, is adequate to protect the wearer's head from injury resulting from bumps, falls or slips while standing, crawling or walking during normal, everyday activity.

2. The head protector of claim 1, wherein the fluid-containing pads contain silastic glen material.

3. The head protector of claim 1, wherein the cap member has a chin strap for securing the head protector about the head of the wearer; the chin strap having a first end and second end, the first end being connected to the first side of the cap member and the second end connected to the second side of the cap member.

4. The head protector of claim 1, wherein the chin strap is elastic.

5. The head protector of claim 1, wherein the cap member comprises a waterproof material.

6. The head protector of claim 1, wherein the one or more plurality of fluid-containing gel pads has an outer skin; said skin being resilient, said gel pads being positioned to form a regular and spaced assembly along the inner surface of the cap member.

7. The head protector of claim 1, wherein the fluid-containing pads contain a highly viscous liquid.

8. The head protector of claim 1, wherein the fluid-containing pads are being substantially uniformly distributed along the inner surface of the cap member.

9. The head protector of claim 1, wherein the fluid containing pads are 0.20 inches to 6.0 inches thick.

10. The head protector of claim 1, wherein the fluid-containing pads are interconnected with each other.

11. The head protector of claim 1, wherein the pliable fabric comprises a water repellant material.

12. The head protector of claim 1, wherein the one or more fluid-containing pads being positioned between the inner and outer surfaces of the cap member.

13. The head protector of claim 1, wherein the head protector comprises a protective ear flap.

14. The head protector of claim 1, wherein a sizing strap being positioned on the outer surface of the cap member; the sizing strap being sized to encircle the cap member; said sizing strap comprising two straps respectively extending from two aperatures on the outer covering of the cap member; said aperatures being positioned at the rear of the head protector.

15. The head protector of claim 1, wherein the chin strap comprises a closing member to secure the head protector on the wearer's head.

16. The head protector of claim 1, wherein the fluid-containing pads consist of a liquid.

17. The head protector of claim 1, wherein the fluid-containing pad comprises an outer skin; said outer skin comprising mylar MYLAR®.

18. The head protector of claim 17, wherein said outer skin comprises vinyl.

19. The head protector of claim 17, wherein said outer skin comprises plastic polyurethane.

20. The head protector of claim 17, wherein said outer skin comprises vinyl-polyurethane.

21. The head protector of claim 16, wherein said liquid is a non-toxic material.

22. The head protector of claim 16, wherein liquid comprises polymeric silicones.

23. The head protector of claim 16, wherein said liquid comprises a mixture of water and glycerin in about equal portions.

24. The head protector of claim 16, wherein said liquid comprises about 30% to 70% glycerin.

25. The head protector of claim 16, wherein the fluid-containing pads are non-interconnected relative to each other.

26. The head protector of claim 1, wherein each of the outer surface and inner surface of the cap member has outer edges, said outer surface and inner surface being connected to each other along their respective edges such that the fluid-containing pads are positioned therebetween.

* * * * *